US005950273A

United States Patent [19]

Suhaka et al.

[11] Patent Number: 5,950,273

[45] Date of Patent: Sep. 14, 1999

[54] NOISE REDUCTION SYSTEM FOR A ROTARY POSITIVE BLOWER

[76] Inventors: Theodore Suhaka, 17 Manito Ave., Oakland, N.J. 07436; Keith D. Murphy, 177 N. Drury La., Newburgh, N.Y. 12550

[21] Appl. No.: 08/934,695

[22] Filed: Sep. 22, 1997

[51] Int. Cl.[6] ..... A47L 5/00

[52] U.S. Cl. ..... 15/326; 15/321; 181/224

[58] Field of Search ..... 15/321, 326; 181/224, 181/233; 138/37, 40

[56] References Cited

U.S. PATENT DOCUMENTS

| | | | |
|---|---|---|---|
| 3,831,223 | 8/1974 | Colt et al. | 15/321 |
| 4,109,340 | 8/1978 | Bates | 15/321 |
| 4,158,248 | 6/1979 | Palmer | 15/321 |
| 4,776,303 | 10/1988 | Duthie et al. | 15/326 |
| 4,940,082 | 7/1990 | Roden | 15/321 |
| 5,159,738 | 11/1992 | Sunagawa et al. | 15/326 |
| 5,521,340 | 5/1996 | Thawani et al. | 181/233 |

*Primary Examiner*—Robert Warden
*Assistant Examiner*—Theresa T. Snider
*Attorney, Agent, or Firm*—Alfred C. Hill

[57] ABSTRACT

A rotary positive blower is driven by a drive device and has an intake port and an exhaust port. A plurality of conduit arrangements each having an inlet coupled to the exhaust port and an outlet, each of the plurality of conduit arrangements have a first predetermined diameter in at least a given portion; and a restriction is disposed in at least one of the plurality of conduit arrangements between the inlet and the outlet of this at least one arrangement, the restriction has a predetermined length and a second predetermined diameter less than the first predetermined diameter to cooperate in reduction of noise and improved efficiency of the drive device and the rotary positive blower.

20 Claims, 1 Drawing Sheet

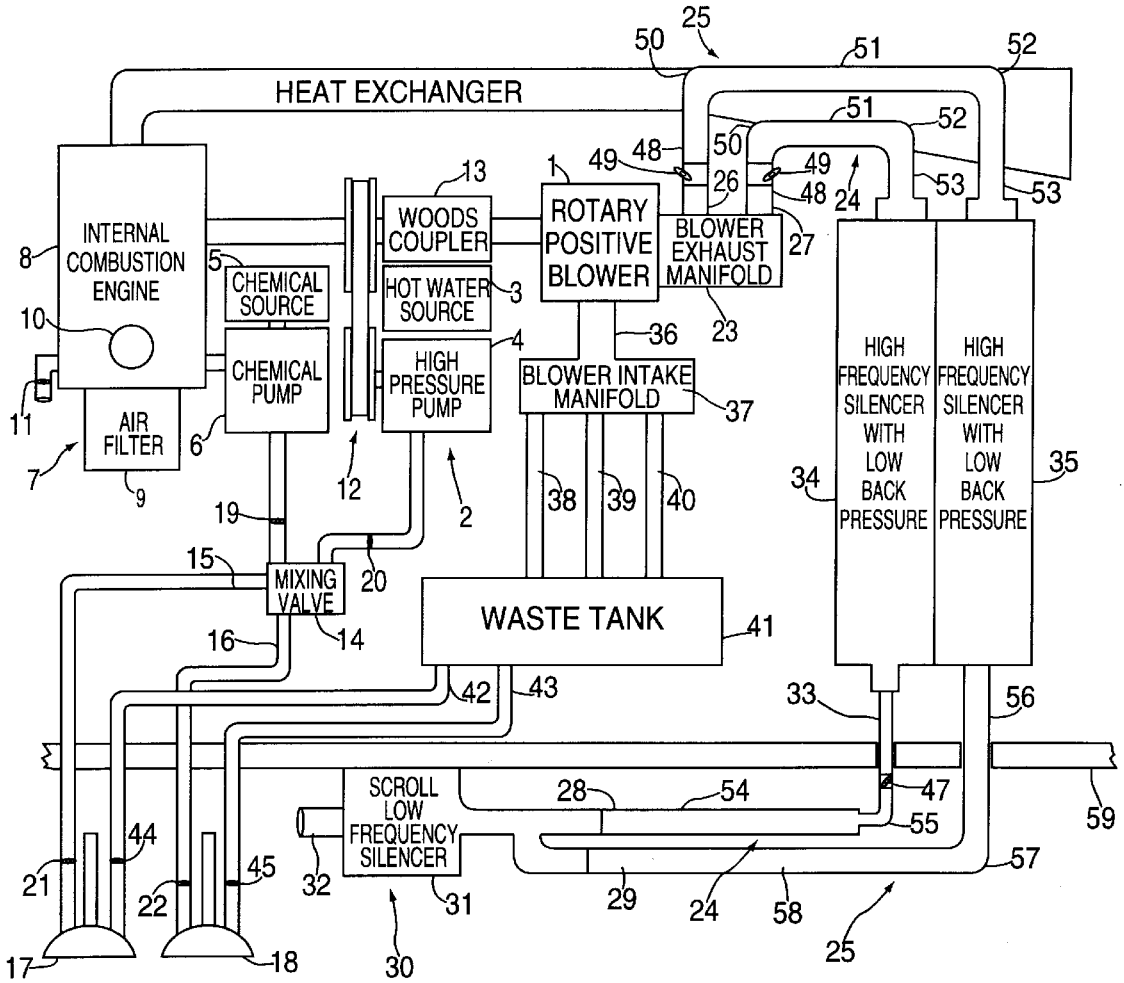

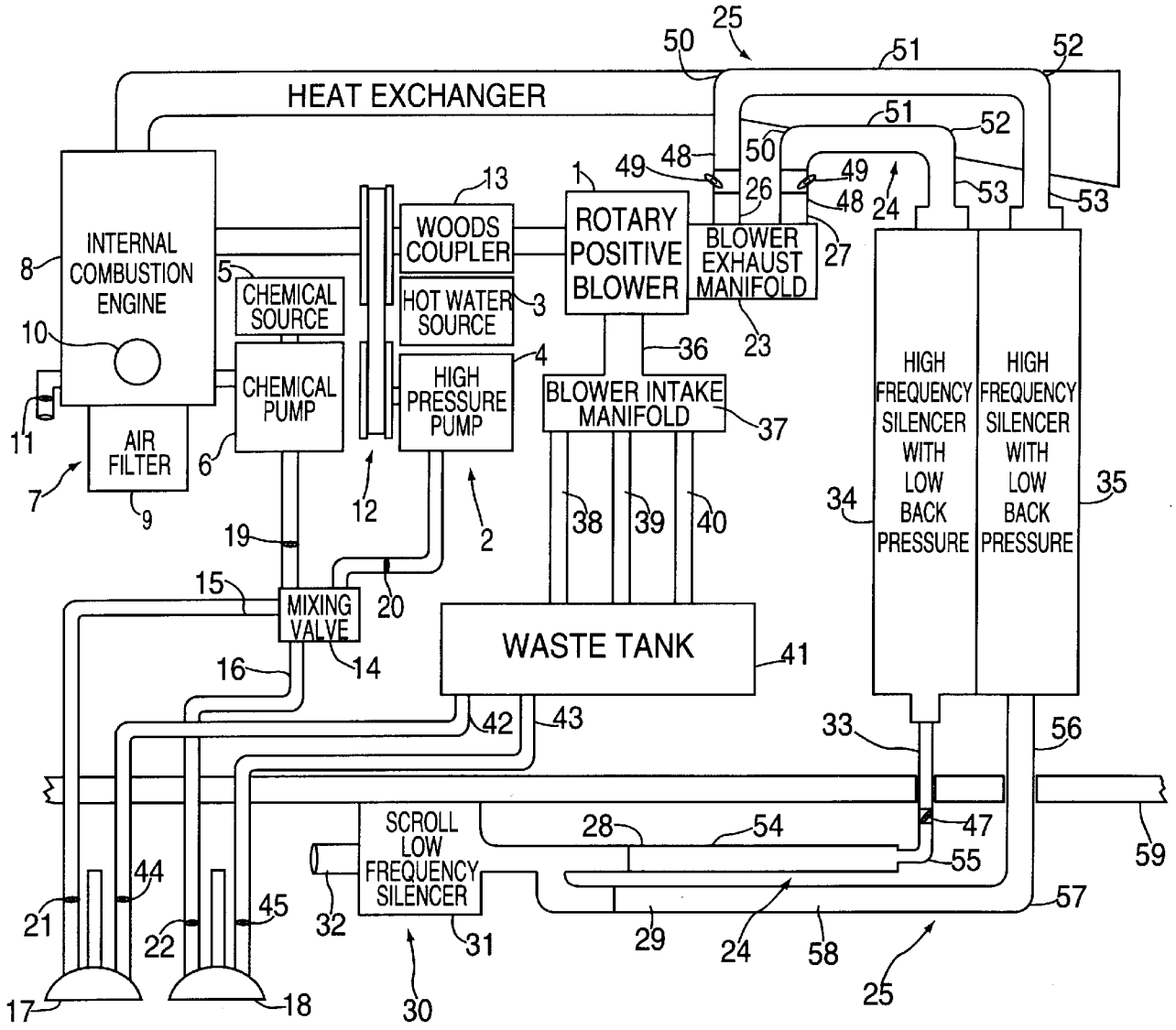
HIGH FREQUENCY SILENCER WITH LOW BACK PRESSURE
HIGH FREQUENCY SILENCER WITH LOW BACK PRESSURE
BLOWER EXHAUST MANIFOLD
ROTARY POSITIVE BLOWER
BLOWER INTAKE MANIFOLD
WASTE TANK
HEAT EXCHANGER
WOODS COUPLER
HOT WATER SOURCE
HIGH PRESSURE PUMP
CHEMICAL SOURCE
CHEMICAL PUMP
MIXING VALVE
SCROLL LOW FREQUENCY SILENCER
INTERNAL COMBUSTION ENGINE
AIR FILTER

NOISE REDUCTION SYSTEM FOR A ROTARY POSITIVE BLOWER

BACKGROUND OF THE INVENTION

The present invention relates to rotary positive blowers and more particularly to a noise reduction system for a rotary positive blower that may be employed in a carpet cleaning system as well as other systems employing rotary positive blowers.

Van mounted steam carpet cleaning machines are known in the art that have parallel high frequency silencers with low back pressure. The outputs of these high frequency silencers are exhausted through two holes cut in the van floor. The two silencers do a sufficient job of suppressing high frequency sounds with very strong low frequency noise exiting out through the van floor. This strong low frequency noise was found to be excessive and at times very embarrassing. Frequently, customers and their neighbors would register strong complaints about the "sound assault" which so dramatically affected the quality of life as the carpets were cleaned in a customer's home. More than once, surrounding homes literally would shake as powerful, low frequency shock waves generated by the large blower reverberated throughout the neighborhoods.

In an attempt to reduce this low frequency noise, the inventive noise reduction system of the present invention was discovered and pleasantly reduced the low frequency noise and included other advantages to the entire carpet cleaning system.

An object of the present invention is to provide a noise reduction system for a rotary positive blower.

SUMMARY OF THE INVENTION

Another object of the present invention is to provide a noise reduction system for the rotary positive blower employed in a van mounted carpet cleaning system.

Still another object of the present invention is to provide a noise reduction system for a rotary positive blower of a van mounted carpet cleaning system that not only reduces the high and low frequency noise, but significantly reduces differential pressure across the blower thereby reducing the load on the internal combustion engine driving the rotary positive blower as well as providing an increased air flow and vacuum in removing the cleaning solution from and drying the carpet, after the carpet cleaning solution has been applied to the carpet.

A feature of the present invention is the provision of a noise reduction system for a rotary positive blower comprising a rotary positive blower having an intake port and an exhaust port; drive means connected to the rotary positive blower to drive the rotary positive blower; a plurality of conduit means each having an inlet coupled to the exhaust port and an outlet, each of the plurality of conduit means having a first predetermined diameter in at least a given portion thereof; and a restriction disposed in at least one of the plurality of conduit means between the inlet and the outlet thereof, the restriction having a predetermined length and a second predetermined diameter less than the first predetermined diameter cooperating to reduce noise and improve efficiency of the drive means and the rotary positive blower.

Another feature of the present invention is the provision of a noise reduction system for a carpet cleaning system comprising a carpet cleaning solution supply means; a rotary positive blower having an intake port and an exhaust port; drive means coupled to the carpet cleaning solution supply means and the rotary positive blower to drive the carpet cleaning solution supply means and the rotary positive blower; at least one wand means coupled to the carpet cleaning solution supply means and the intake port of the rotary positive blower to deliver carpet cleaning solution to a carpet to be cleaned and to extract the carpet cleaning solution from the carpet and to dry the carpet; a plurality of conduit means each having an inlet coupled to the exhaust port of the rotary positive blower and an outlet, each of the plurality of conduit means having a first predetermined diameter in at least a given portion thereof; and a restriction disposed in at least one of the plurality of conduit means between the inlet and the outlet thereof, the restriction having a predetermined length and a second predetermined diameter less than the first predetermined diameter cooperating to reduce noise and improve efficiency of the drive means and the rotary positive blower.

BRIEF DESCRIPTION OF THE DRAWING

Above-mentioned and other features and objects of the present invention will become more apparent by reference to the following description taken in conjunction with the accompanying drawing, in which the sole FIGURE thereof is a block schematic diagram illustrating the carpet cleaning system employing a rotary positive blower with its'noise reduction system in accordance with the principles of the present invention.

DESCRIPTION OF THE PREFERRED EMBODIMENT

Referring to the Figure, the noise reduction system for a carpet cleaning system is schematically shown in block diagram form including a rotary positive blower 1 that contributes the majority of the unpleasant noise mentioned hereinabove. The carpet cleaning system includes further a carpet cleaning solution supply means 2 including a hot water source 3, a high pressure pump 4, a chemical source 5 and a chemical pump 6.

A drive means 7 is coupled to the carpet cleaning solution supply means 2 and the rotary positive blower 1 to drive these elements. The drive means 7 includes an internal combustion engine 8, an air filter 9, an oil filter 10 and an oil drain valve 11. Internal combustion engine 8 directly drives the chemical pump 6 and through a clutch arrangement 12, the high pressure pump 4. A Woods coupler 13 is employed to drive the rotary positive blower 1. The output from chemical pump 6 and the high pressure pump 2 are coupled to a mixing valve 14 illustrated to have two outputs 15 and 16 coupled to wands 17 and 18 to deliver a carpet cleaning solution to a carpet to be cleaned. Valves 19, 20, 21 and 22 control the amount of cleaning solution delivered to the carpet. These valves 19–22 are controlled by the operator to maximize the cleaning of the carpet.

Coupled to the exhaust port of rotary positive blower 1 is a blower exhaust manifold 23 to which is coupled a plurality of conduit means illustrated to be a pair of conduit means 24 and 25. Conduit means 24 and 25 each have an input 26 and 27, respectively, coupled to the exhaust port of rotary positive blower 1 through the exhaust manifold 23. Conduit means 24 and 25 also have outlets 28 and 29, respectively. Conduit means 24 and 25 have a first predetermined diameter in at least a given portion thereof, for instance, 2½" internal diameter (I.D.).

A restriction 33 is disposed in at least one of the plurality of conduit means illustrated in the drawing to be in conduit means 24 of the pair of conduit means 24 and 25. The restriction 33 can be disposed in any number of the plurality of conduit means. The restriction 33 is disposed between the inlet 27 and the outlet 28 of the conduit means 24. This restriction 33 could be placed in the conduit means 25 in a similar location to that shown in conduit means 24. The restriction 33 has a predetermined length, for example 16", and a second predetermined diameter less than the first predetermined diameter, for instance, 2"I.D. This restriction 33 cooperates to reduce the noise emanating from the rotary positive blower 1 and to improve the efficiency of the drive means 7 and the entire carpet cleaning system.

Each of the conduit means 24 and 25 could employ piping from the inlets 26 and 27 to the area of the restriction 33. However, it is preferred to provide high frequency silencers 34 and 35 in the conduit means 24 and 25, respectively, to improve the noise emanating from the carpet cleaning system. The silencers 34 and 35 each have a low back pressure.

The noise at the outlets 28 and 29 of conduit means 24 and 25, respectively, is greatly reduced and is at an acceptable level. However, to remove residual noise at the outlets 28 and 29, a combining means 30, such as a scroll low frequency silencer 31, is coupled to outlets 28 and 29 resulting in a further reduction in the noise level at the single output 32 therefrom.

The rotary positive blower 1 has an intake port 36 coupled to the blower intake manifold 37 from which three pipes or hoses 38, 39, and 40 are attached between the manifold 37 and a waste tank 41 which has sufficient strength to withstand the vacuum generated by the rotary positive blower 1 and the conduit means 24 and 25 in accordance with the principles of the present invention. It should be noted that the pipes from manifold 37 could number one, two, three or more than three. At the output of waste tank 41 are coupled two lines 42 and 43 which are coupled to wands 17 and 18, respectively. Lines 42 and 43 have control valves 44 and 45 disposed therein, respectively, to enable the control of the vacuum applied to wands 17 and 18. Lines 42 and 43 coupled to wands 17 and 18 enable the removal of the carpet cleaning solution applied through lines 15 and 16 from the carpet being cleaned and to also assist in drying the carpet that has been cleaned.

Valves 46 and 47 enable control of the pressure in the conduit means 25 and the vacuum generated in the conduit means 24, respectively. Each of the pair of conduit means 24 and 25 include a first straight section 48 containing the inputs 26 and 27, respectively, and a control valve 49 to control the flow of air in the conduit means 24 and 25. The conduit means 24 and 25 further include a first right angle section 50 coupled to the straight section 48, a second straight section 51 coupled to the right angle section 50, a second right angle section 52 coupled to the straight section 51 and a third straight section 53 coupled to the right angle section 52 and to the inlet of the silencers 34 and 35. The sections 48, 50, 51, 52, and 53 have the first predetermined diameter, which in the instant example is 2½" I.D.

The conduit means 24 containing the restriction 33 has a fourth straight section 54 having outlet 28, or which can be coupled to an inlet of low frequency silencer 31. Fourth straight section 54 has the first predetermined diameter mentioned hereinabove. The restriction 33 is coupled between an outlet of the high frequency silencer 34 and an inlet of the fourth straight section 54. The restriction 33 includes a right angle portion 55 adjacent the inlet of the fourth straight section 54.

The conduit means 25 includes a fifth straight section 56 coupled to an outlet of the high frequency silencer 35, right angle section 57 coupled to the straight section 56 remote from the silencer 35 and a sixth straight section 58 coupled between the right angle section 57 and outlet 29, or an inlet of the low frequency silencer 31. The straight section 56, the right angle section 57 and the straight section 58 all have the first predetermined diameter which in the example employed herein is 2½" I.D.

The major part of the noise reduction is achieved in accordance with the principles of the present invention as a result of the use of the restriction 33 at the output of the high frequency silencer 34. The low frequency silencer 31 of the scroll type removes any residual noise that may be present at outlets 28 and 29. In the discussion to follow the section 54 will be referred to as a vacuum line or section and the section 58 will be referred to as the pressure line or section.

The discovery or the use of the restriction 33 was by accident, since when it was attempted to provide the scroll low frequency silencer 34 underneath the truck floor 59, it was impossible to run a 2½ I.D. line similar to sections 56, 57 and 58 from the outlet of the high frequency silencer 34 due to an obstruction in the form of a metal brace on which the van shock absorber was attached. Due to this obstruction it was impossible to provide a 2½" I.D. line from the outlet of the silencer 34 to the silencer 31. To get around this obstruction it was decided to use a 2" I.D. section of hose in order to clear the obstruction. As mentioned above the total length of the restriction 34 is 16" in the embodiment built.

The employment of this restriction along with the low frequency silencer 31 resulted in a much quieter output from silencer 31 at outlet 32 and an increased vacuum at wands 17 and 18. In addition, the entire carpet cleaning system was a much quieter system. In fact, when cleaning and using the wands 17 and 18 it seemed as if the wands 17 and 18 were "alive" and humming and vibrating in the hand of the operator. It was found that the wands 17 and 18 could only be pushed and pulled on the carpet with much effort, the wands 17 and 18 attaching extra hard onto the carpet, pulling it high off the floor yanking it off the tack strips with ease. The noise coming from the tools vacuum inlet was deafening. It was thought at first that something had drastically gone wrong with the machine in the van. But upon observing the unit in the van it was found that the revolutions per minute (RPM) and the vacuum relief valve were fine. The work was continued for the rest of the day using a 25' length of 1½" vacuum hose at the end of the usual 2" vacuum hose which seemed to tame the noise and the vacuum in the wands 17 and 18.

It is essential that the internal combustion engine be of sufficient power to produce a high cubic feet per minute (C.F.M.) movement of air, a high vacuum and a high velocity. The internal combustion engine 8 produces twice the brake horse power to operate the rotary positive blower 1. The inlet side of blower 1 is outfitted so as to produce high velocity of air movement. In the embodiment developed and used this was accomplished by screwing a 5" I.D. male inlet manifold 37 into the 5" female port on the blower inlet side 36. Manifold 37 is about 6" long and is fitted with three 2" I.D. male nipples welded to produce an inlet. Reduction of the area from the 19.625 square inches to 9.42 square inches is to create greater velocity than if the system were "open throated" with a significant drop in air volume. The three 2" I.D. vacuum hoses 38–40 were attached to the nipples on the blower inlet manifold 37 and routed to a large heavy duty waste water tank 41 capable of withstanding high vacuum pressures without collapsing. Waste tank 41 could be 1 foot wide by 5 foot long by 4 to 4½ feet high. The three hoses 38–40 are attached to the waste tank 41 at three discreet points separated by a spaced of about 6 to 8 inches so as to reduce the turbulence, which would occur with one large port. The increase of air velocity caused by the square inch reduction on the inlet manifold 37 of the blower 1 is transferred to the waste tank 41, which then in turn draws air into itself at high velocity through the tank inlets to which are connected are the cleaning hoses 42 and 43.

Screwed into the 5" female pipe thread outlet port of the blower 1 is another 5" manifold 23 on which are welded two 2½" exhaust nipples which are attached to low back pressure canister type 2½" high frequency silencers 34 and 35. It is preferable the silencers 34 and 35 be piped in such a way that they exhaust out through the bottom of the van in which the carpet cleaning system is mounted. Again, it is significant that the outlet side of blower 1 be reduced from 19.62 square inches in area to 9.8125 square inches through two 2½" piped channels, this enhances the activity of the carpet cleaning system by creating needed exhaust velocity to make restriction 33 enhance blower 1 activity. Two conduit means 24 and 25 are present on the outlet side of blower 1 which are sized to create significant velocity and positive pressure, without sacrificing exhaust or outlet air C.F.M. in proportion to the blowers individual capacity. Creating a restriction 33 which impedes the blowers'exhaust flow is normally undesirable, but in accordance with the present invention restriction 33 creates an exhaust scavenger action. The scavenger action can also be accomplished with multiple pipe channels on the blower outlets, though this would seem to be an unnecessary complication, or perhaps a way to employ the principle without violating the resultant patent. The use of pipes in place of the silencers 34 and 35 is mentioned herein to demonstrate that the inventor has contemplated such a use and, therefore, would prevent someone from avoiding his patent by using such a technique.

The phenomenon discovered begins to take place at the terminal end or outlet side of the silencer 34 and 35, or the pipes that could possibly replace these silencers. One of the outlets is left open throated, or free and clear, while the other is diminished in diameter over a short run, such as at restriction 33, before opening up again to a larger diameter section. This restriction develops a sudden drop in pressure. As a result an exhaust scavenger of dynamic power and activity is made. It should be noted here that the scavenger effect can be controlled and/or modified in either raising or lowering the power of its intensity by varying the length of the run of the restricted area and/or the I.D. of the restricted area in relation to the outlet of lesser restriction. The same holds true to the I.D. and the and/or length of the outlet of the lesser restriction in relation to the scavenger line.

One of the great benefits of the system disclosed is that the blower 1 exhaust does not exit out of the system against an efficiency robbing wall of hard, atmospheric pressure, but rather is being eased out of the system through negative pressure, in other word pressure below atmospheric pressure, with the result that the blower 1 performs with noticeably greater power and efficiency. Even the internal combustion engine 8 seems to love this system, as it purrs along without strain. The scavengering effect is in full force no matter what speed the internal combustion engine 8 is set at, from the minimum to maximum and every speed in between. In the working model lines 54 and 58 are 6' long and 2½" I.D. sections fastened and clamped to the low pressure scroll silencer 31 which further reduces the already lowered noise level.

It is submitted here that another reason why the working model performed so extraordinarily well is because we are able to produce a tremendous pressure drop in the restriction 33 while at the same time preserving most of the overall orifice space. Remember, restriction 33 has only a length of 16". Two 2½" hoses have a combined orifice area of 9.8125 square inches, while when considering the area of the 16" restriction to 2½" I.D., the combined orifice space of a 2" hose and a 2½" hose is 8.046625 square inches, a reduction of only 1.76625 square inches, or just 18% over a short 16" run. This means the system behaves as if it were still wide open while combined with a powerful scavenger action.

Another wonderful product which comes with the carpet cleaning system disclosed herein is reduced blower exhaust noise. The worst blower exhaust noise is produced when positively pressurized high velocity air is "slapped" against atmospheric air pressure. Because exhaust flow is lower then atmospheric pressure, outlet air flow takes on far less offensive acoustical characteristics. The noise production of a cleaning system outfitted with the system described herein will become much more environmentally friendly, i.e., less likely to disturb the peace than any other silencer configurations. When a stethoscope is placed on the pressure channel 58 as the unit is running, you can hear the offensive, characteristic "fog horn" like low frequency noise. The same stethoscope placed on the vacuum channel or section 54 reveals near silence. Then, the long involuted design of the scroll silencer 31 almost totally eliminates the remaining positive pressure noise as it does not have to try so hard.

While we have described above the principles of our invention in connection with specific apparatus, it is to be clearly understood that this description is made only by way of example and not as a limitation to the scope of our invention as set forth in the objects thereof and in the accompanying claims.

We claim:

1. A noise reduction system for a rotary positive blower comprising:

a rotary positive blower having an intake port and an exhaust port;

drive means connected to said rotary positive blower to drive said rotary positive blower;

a plurality of conduit means each having an inlet coupled to said exhaust port and an outlet, each of said plurality of conduit means having a first diameter in at least a given portion thereof; and a noise reduction system including at least a restriction disposed in at least one of said plurality of conduit means between said inlet and said outlet thereof, said restriction having a predetermined length and a second predetermined diameter less than said first predetermined diameter cooperating to reduce noise and improve efficiency of said drive means and said rotary positive blower.

2. A system according to claim 1, wherein said noise reduction system further includes a high frequency silencer having a low back pressure to silence high frequencies disposed in each of said plurality of conduit means.

3. A system according to claim 2, wherein said restriction is disposed between an outlet of said high frequency silencer in said at least one of said plurality of conduit means and said outlet of said at least one of said plurality of conduit means.

4. A system according to claim 3, wherein said drive means includes an internal combustion engine.

5. A system according to claim 3, wherein said exhaust port of said rotary positive blower is coupled to an exhaust manifold coupled to said inlet of each of said plurality of conduit means; and each of said plurality of conduit means further includes a first straight section containing said inlet coupled to said exhaust manifold, said first straight section having said first predetermined diameter, a first right angle section coupled to said first section remote from said exhaust manifold, said first right angle section having said first predetermined diameter, a second straight section coupled to said first right angle section remote from said first straight section, said second straight section having said first predetermined diameter, a second right angle section coupled to said second straight section remote from said first right angle section, said second right angle section having said first predetermined diameter, and a third straight section coupled between said second right angle section remote from said second straight section and an input of an associated one of said high frequency silencer, said third straight section having said first predetermined diameter.

6. A system according to claim 5, wherein said at least one of said plurality of conduit means includes a fourth straight section having an outlet providing said outlet of said at least one of said plurality of conduit means, said fourth straight section having said first predetermined diameter, and said restriction coupled between an outlet of an associated one of said high frequency silencer and an inlet of said fourth straight section, said restriction having a right angle portion adjacent said inlet of said fourth straight section; and said others of said plurality of conduit means includes a fifth straight section coupled to an outlet of an associated on of said high frequency silencer, said fifth straight section having said first predetermined diameter, a third right angle section coupled to said fifth straight section remote from said associated one of said high frequency silencer, said third right angle section having said first predetermined diameter, and a sixth straight section coupled between said third right angle section remote from said fifth straight section and said outlet of said others of said plurality of conduit means.

7. A system according to claim 6, further including valve means disposed in each of said plurality of conduit means and said restriction to enable control of the flow of fluid therethrough.

8. A system according to claim 1, further including valve means disposed in each of said plurality of conduit means and said restriction to enable control of the flow of fluid therethrough.

9. A system according to claim 1, wherein said noise reduction system further includes combining means coupled to said outlet of each of said plurality of conduit means to combine the flow of fluid in each of said plurality of conduit means to provide a single outlet for the flow of fluid in each of said plurality of conduit and to further reduce noise.

10. A system according to claim 9, wherein said combining means includes a low frequency silencer.

11. A noise reduction system for a carpet cleaning system comprising:

a carpet cleaning system including a carpet cleaning solution supply means;

a rotary positive blower having an intake port and an exhaust port;

a drive means coupled to said carpet cleaning solution supply means and said rotary positive blower to drive said carpet cleaning solution supply means and said rotary positive blower;

at least one wand means coupled to said carpet cleaning solution supply means and said intake port of said rotary positive blower to deliver carpet cleaning solution to a carpet to be cleaned and to extract said carpet cleaning solution from said carpet and to dry said carpet; and a plurality of conduit means each having an inlet coupled to said exhaust port of said rotary positive blower and an outlet, each of said plurality of conduit means having a first predetermined diameter in at least a given portion thereof; and a noise reduction system including at least a restriction disposed in at least one of said plurality of conduit means between said inlet and said outlet thereof, said restriction having a predetermined length and a second predetermined diameter less than said first predetermined diameter cooperating to reduce noise and improve efficiency of said drive means and said carpet cleaning system.

12. A noise reduction system according to claim 11, wherein said noise reduction system further includes a high frequency silencer having low back pressure to silence high frequencies disposed in each of said plurality of conduit means.

13. A noise reduction system according to claim 12, wherein said restriction is disposed between an outlet of said high frequency silencer in said at least one of said plurality of conduit means and said outlet of said at least one of said plurality of conduit means.

14. A noise reduction system according to claim 13, wherein said drive means include an internal combustion engine.

15. A noise reduction system according to claim 13, wherein said exhaust port of said rotary positive blower is coupled to an exhaust manifold coupled to said inlet of each of said plurality of conduit means; and each of said plurality of conduit means further includes a first straight section containing said inlet coupled to said exhaust manifold, said first straight section having said first predetermined diameter, a first right angle section coupled to said first section remote from said exhaust manifold, said first right angle section having said first predetermined diameter, a section straight section coupled to said first right angle section remote from said first straight section, said straight section having said first predetermined diameter, a second right angle section coupled to said second straight section remote from said first right angle section, said second right angle section having said first predetermined diameter, and a third straight section coupled between said second right angle section remote from said second straight section and an input of an associated one of said high frequency silencer, said third straight section having said first predetermined diameter.

16. A noise reduction system according to claim 15, wherein said at least one of said plurality of conduit means includes a fourth straight section having an outlet providing said outlet of said at least one of said plurality of conduit means, said fourth straight section having said first predetermined diameter, and said restriction coupled between an outlet of an associated one of said high frequency silencer and an inlet of said fourth straight section, said restriction having a right angle portion adjacent said inlet of said fourth straight section; and said others of said plurality of conduit means includes a fifth straight section coupled to an outlet of an associated one of said high frequency silencer, said fifth straight section having said first predetermined diameter, a third right angle section coupled to said fifth straight section remote from said associated one of said high frequency silencer, said third right angle section having said first predetermined diameter, and a sixth straight section coupled between said third right angle section remote from said fifth straight section and said outlet of said others of said plurality of conduit means.

17. A noise reduction system according to claim 16, further including valve means disposed in said carpet cleaning solution supply means, said wand means, each of said plurality of conduit means and said restriction to enable control of the flow of fluid therethrough.

18. A noise reduction system according to claim 11, further including valve means disposed in said carpet cleaning solution supply means, said wand means, each of said plurality of conduit means and said restriction to enable control of the flow of fluid therethrough.

19. A noise reduction system according to claim 11, wherein said noise reduction system further includes combining means coupled to said outlet of each of said plurality of conduit means to combine the flow of fluid in each of said plurality of conduit means to provide a single outlet for the flow of fluid in each of said plurality of conduit means and to further reduce noise.

20. A noise reduction system according to claim 19, wherein said combining means includes a low frequency silencer.

* * * * *